US005409115A

United States Patent [19]

Barkhorn

[11] Patent Number: 5,409,115

[45] Date of Patent: Apr. 25, 1995

[54] TUBULAR BAG PACKAGING, FOR BANDAGE-LIKE MATERIALS IN PARTICULAR

[75] Inventor: Gerald Barkhorn, Bendorf, Germany

[73] Assignee: Lohmann GmbH & Co. KG, Neuwied, Germany

[21] Appl. No.: 117,074

[22] PCT Filed: Feb. 26, 1992

[86] PCT No.: PCT/EP92/00398

§ 371 Date: Oct. 21, 1993

§ 102(e) Date: Oct. 21, 1993

[87] PCT Pub. No.: WO92/15497

PCT Pub. Date: Sep. 17, 1992

[30] Foreign Application Priority Data

Mar. 8, 1991 [DE] Germany ..... 41 07 380.0

[51] Int. Cl.[6] ..... A61B 17/06; B65D 65/00

[52] U.S. Cl. ..... 206/440; 229/87.05; 383/211

[58] Field of Search ..... 206/440; 229/87.05; 383/210, 211, 201

[56] References Cited

U.S. PATENT DOCUMENTS

| | | | |
|---|---|---|---|
| 1,977,759 | 10/1934 | Ford | 383/211 |
| 2,324,017 | 7/1943 | Neumair | 229/87.05 |
| 2,676,702 | 4/1954 | Whitefoot, Jr. | 383/211 |
| 2,897,087 | 7/1959 | Lawlor | 229/87.05 |
| 3,455,438 | 7/1969 | Fitzgerald | 206/440 |
| 3,497,131 | 2/1970 | Treacy | 229/87.05 |
| 3,768,725 | 10/1973 | Pilaro | 383/210 |
| 4,337,862 | 7/1982 | Suter | 383/211 |
| 4,826,011 | 5/1989 | Jud | 229/87.05 |
| 5,184,771 | 2/1993 | Jud et al. | 383/211 |

FOREIGN PATENT DOCUMENTS

| | | |
|---|---|---|
| 399420 | 5/1990 | European Pat. Off. . |
| 2190684 | 2/1974 | France . |
| 3618765 | 12/1987 | Germany . |
| 3917048 | 11/1990 | Germany . |
| 651795 | 10/1985 | Switzerland . |

*Primary Examiner*—Steven N. Meyers
*Assistant Examiner*—Marie Denise Patterson
*Attorney, Agent, or Firm*—Collard & Roe

[57] ABSTRACT

The invention concerns a tubular bag packing, for bandage-like materials in particular, consisting of a web of foil whose opposite borders are glued or welded together along a longitudinal seam to form a tube enveloping the material to be packed and which is hermetically sealed at its ends by means of two parallel transverse seams and which exhibits at least one aid to opening, enabling it to be torn open quickly and completely in order to remove the contents, that is characterized in that one longitudinal strip (10) of the web of foil (11) projects loosely beyond the longitudinal seam (5) and that this is formed into comparatively short, continuously recurring longitudinal spaces (A1, A2, A3, etc.) with tear-off tongues (12*a*, 12*b*, 12*c* etc.) between notches for tearing (13*a*, 13*b*, 13*c* etc.) which limit one another.

7 Claims, 2 Drawing Sheets

TUBULAR BAG PACKAGING, FOR BANDAGE-LIKE MATERIALS IN PARTICULAR

DESCRIPTION

Figure 1:
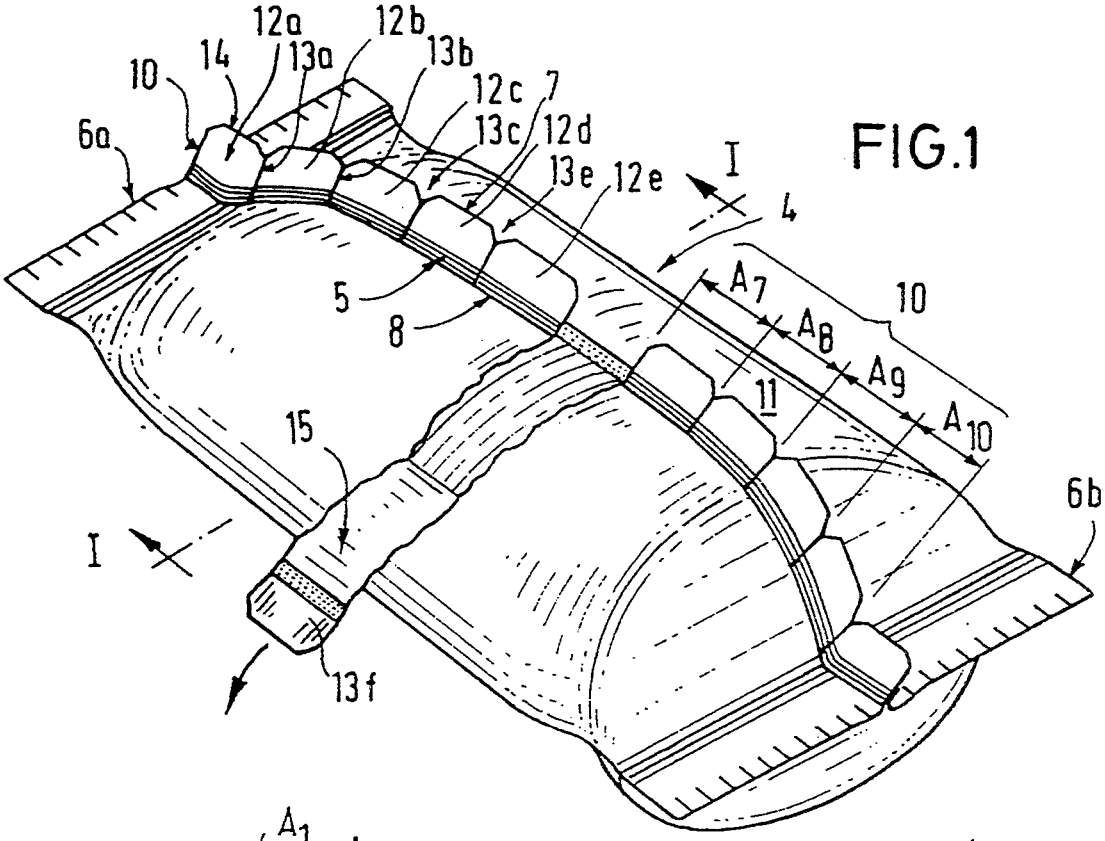

The invention concerns a tubular bag packaging, for bandage-like materials in particular, consisting of a web of foil whose opposite borders are glued or welded together along a longitudinal seam to form a tube enveloping the material to be packed and which is hermetically sealed at its ends by means of two parallel transverse seams and which exhibits at least one aid to opening, enabling it to be torn open quickly and completely in order to remove the contents.

A tubular bag packaging for pressure-sensitive material, for example layers of cheese slices, is known from FR-A-2 190 684. A web of foil made of composite material of polyamide and polyethylene, the latter forming the inner layer and the polyamide the outer layer, serves as packaging material. When the borders of the web of foil are glued or welded together, a sealing seam running lengthwise is formed, whereas the ends are sealed tightly by means of transverse seams. An incision in that part of the longitudinal seam projecting beyond the ends of the packaging and intersecting with the transverse seams in the vicinity of the inner angle of the fin of the seam serves as an aid to opening. The notch extends preferably into the area where the longitudinal and transverse seams intersect. A tear-off strip results at the end of the longitudinal seam and when this strip is pulled along the line of the seam, it serves to open the packaging. Removing the contents of the packaging after the longitudinal seam has been torn off proves to be a disadvantage for the customer, as the transverse seams are not opened at the same time and the manipulation required is unnecessarily complicated. This difficulty may still be reasonable and acceptable when it involves the removal of foodstuffs, but an aid to opening of this kind on the packaging of medical Goods such as bandages for staunching the flow of blood etc. is not acceptable. In addition the notch must be constructed in such a manner that it penetrates far enough into the area of intersection of the longitudinal and transverse seams, on the one hand, but, on the other hand it must not be so deep that it endangers the hermetic seal of the foodstuff contents. This requires at least a separate working operation during automatic packaging, thus reducing the speed of packaging.

A tubular bag packaging for material in the form of a bar or cake, such as, for instance, chocolate products, consisting of a foil-like or paper-like covering possessing two transverse seams running parallel to one another, formed by glueing or welding, and one longitudinal seam running vertically to these transverse seams, formed by means of face ends protruding as a tear-off tab and also joined firmly to one another by means of glueing or welding and which can be opened by pulling the tear-off tab along this seam line, is known from DE-OS 36 18 765. The task to he solved by this invention is that of creating a tubular hag packaging for material in the form of a bar or cake, for example chocolate products, which can be packed at high speed and opened easily along the longitudinal seam without its covering being damaged. It is proposed, as a solution, that on at least one face end of the tear-open tab in the vicinity of at least one transverse seam an opening he constructed which touches the longitudinal seam at least and is open at the side. The opening is an approximately semi-circular notch which has been punched out. A disadvantage of this tubular bag packing is the low stress concentration, which means that there is insufficient weakening in the area of intersection of the transverse and longitudinal seams, resulting in an aid to opening which is only of limited use when the packaging is torn open. The outcome is that the applicability of the proposed aid to opening is restricted and the latter can basically only he used for material in the form of a cake or bar and for packaging which can he torn easily.

Folding packaging is known from DE-OS 39 17 048, made out of a single web of foil and folded and sealed around the material to be packed in such a way that the latter is surrounded all round by it and the packaging is air-tight. The seal is achieved in this case by glueing those borders of the web of foil lying opposite one another in each case which frame the inner area of the web of foil at the sides. The invention consists of the fact that two borders lying opposite one another exhibit at least one non-permanent adhesive area, whereby these areas lie on top of one another in the state which prevails when the packaging has been folded into a folding packaging, and that one of these two borders is partly divided from the remaining border area along its circumferential line as far as the material is concerned. Moreover the adhesive layers between these two areas and the inner area exist in such a way in each case that the inner area of the adhesive layer is completely surrounded at the sides.

The openings in the adhesive layer area are a disadvantage in this connection. They represent a weakening of the adhesive layer at that place each time and increase the danger of the air-tight and water-tight seal being damaged. Also, the structural break in the adhesive layer is only suitable for a special adhesive technique involving correspondingly complicated means. In contrast, for instance, to the hot-melt welding process, the glueing of the borders of the foil with an adhesive layer which is interrupted in places requires a much higher expenditure on technical resources, which is only economically meaningful if the number of packaging items is very large and the dimensions of the packagings do not change.

From CH-A-651 795 a packaging for unit loads is known, provided with a longitudinal seam fin, whereby the borders of the web of foil forming the packaging are connected in such a manner that they do not protrude. The longitudinal fin seam is provided with incisions extending from its border to the middle area. Upon tearing open, both borders of the web of foil, connected along the longitudinal fin seam, are grasped, whereby the tearing open is performed at least partially along the longitudinal fin seam. In the process, the packaging is to be opened only partially, so that, upon removing part of the contents, one part of the packaging functions as a protection against dirtying of the hands. This packaging is unsuitable for the quick and complete removal of bandage-like materials.

It is an object of the present invention to provide a tubular bag packaging which overcomes the prior art difficulties, and is suitable, at the same time, for the packaging of bandage-like materials such as sterile gauze or plaster bandages in particular, and which, when torn open in a controlled manner in an area between the transverse seams, makes it possible to open the packaging and remove the goods to be packed rapidly and completely, this being realized with conventional machines for packing and sealing and at high packaging speeds.

This object is accomplished by a tubular bag packaging according to the invention. This form results in tear-off tongues running at right-angles to the longitudinal seam between the notches for tearing in one of the strips projecting beyond the longitudinal seam of the web of foil and making it possible to tear open the tubular bag in an area between the transverse seams. The tubular bag is thus divided into two halves, which can be folded out to remove the contents, or, when torn open completely, even removed entirely, rendering the contents, for instance a bandage, optimally accessible. Furthermore, the tearing open of the tubular bag can be solved optimally from an ergonomical viewpoint through the formation of the tear-off tongues, whereby one hand clasps the tubular bag in such a manner, that the middle part of it lies between thumb and fingers, the second hand grasping the tear-off tongue and pulling it out at right-angles to the longitudinal seam. When handled in this manner, the packaging is opened gently and completely, without the goods to be packed being crushed or damaged.

Figure 2:
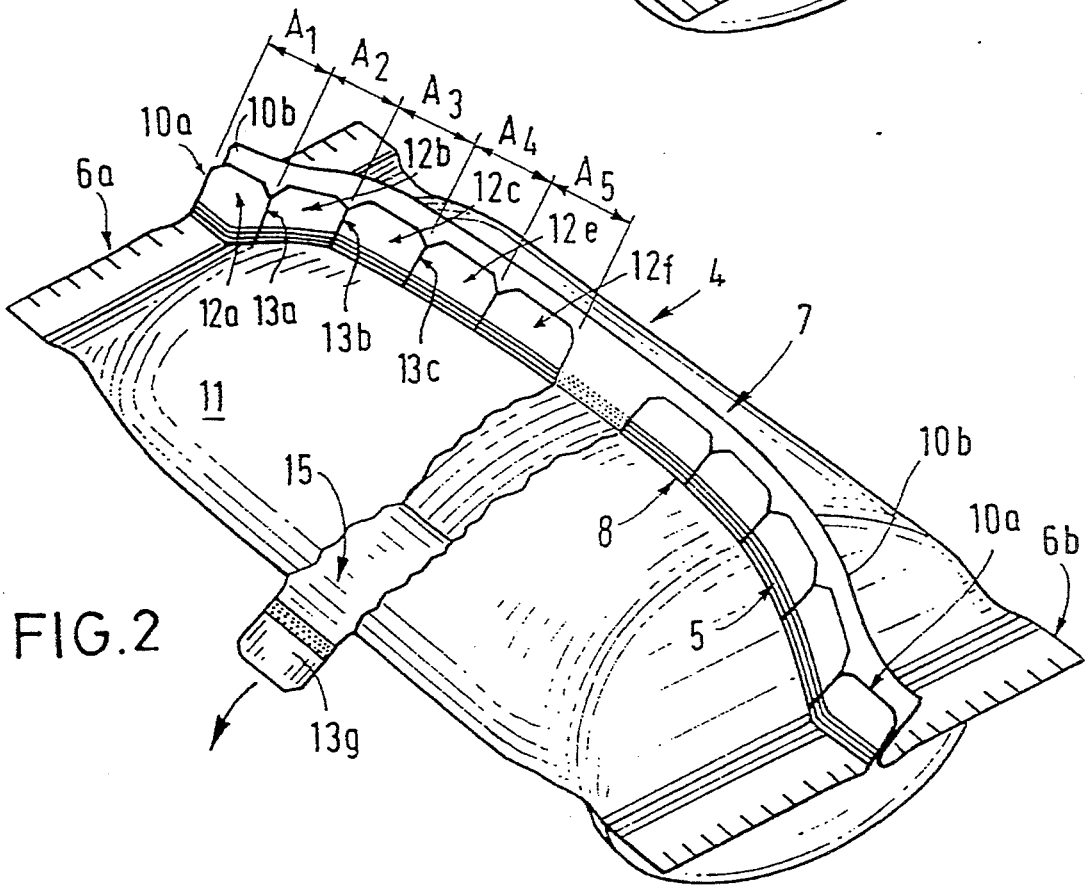
Figure 3:
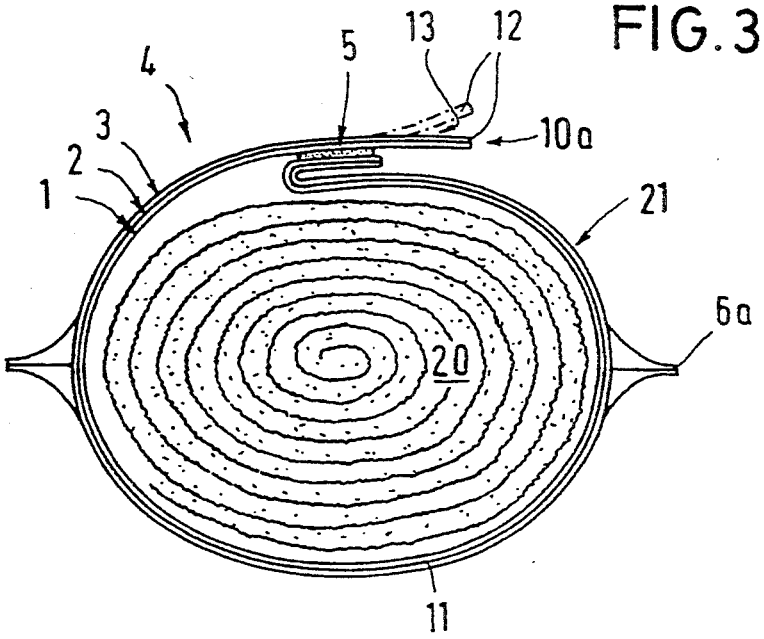
Figure 4:
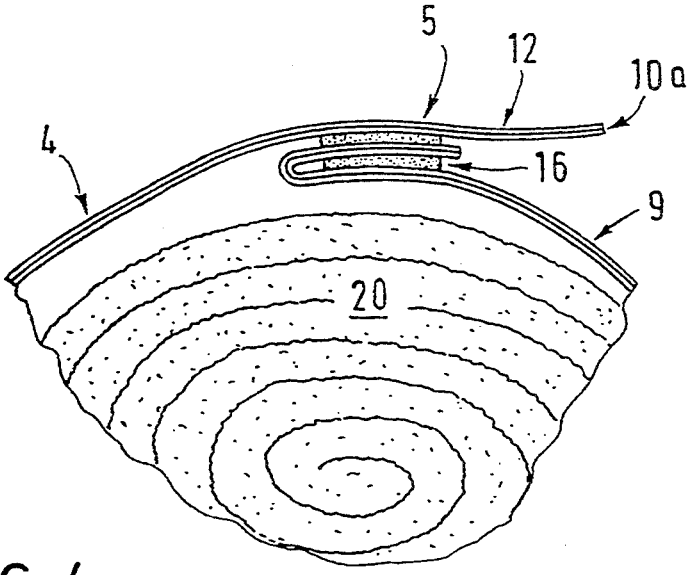

The object matter of the invention is shown in preferred embodiments in schematic drawings. Further advantageous details of the invention can be inferred from the drawings. The drawings show in detail:

FIG. 1: A perspective representation of a tubular bag packaging with a foil projecting over the longitudinal seam on one side;

FIG. 2: A perspective view of a tubular bag packaging with foil projecting over the longitudinal seam on both sides;

FIG. 3: A cross-section through the packaging along the cutting plane I—I in FIG. 1;

FIG. 4: A detail reproduction of the longitudinal seam, also in the section of the cutting plane I—I in FIG. 1.

In FIGS. 1 and 2 tubular bag packagings 4 for bandage-like material in particular are shown. They consist of a web of foil 11, whose opposite borders 7, 8 together with a longitudinal seam 5 form a tube 21 enveloping the material to be packed and which is hermetically sealed at the ends by means of two parallel transverse seams 6*a*, 6*b*. According to the invention, a longitudinal strip 10 of the web of foil 11 projects loosely beyond the longitudinal seam 5 and is formed into comparatively short, continuously recurring longitudinal spaces A1, A2, A3 etc., with tear-off tongues 13*a*, 13*b*, 13*c*, etc. To open the tubular bag packaging 4, a tear-off tongue 13*f* (FIG. 1) or 13*g* (FIG. 2 ) is grasped and wripped out between two notches for tearing 13. First of all, in this connection, the limited resistance of the longitudinal seam 5 must be overcome, whereupon a tab for pulling 15 appears, which tears open the tubular bag shown in FIGS. 1 and 2. In the variant shown in FIG. 2, both longitudinal strips 10*a* and 10*b* on both borders 7, 8 protrude over the longitudinal seam 5. The longitudinal strip 10*a* exhibiting the notches for tearing 13 is narrower than the longitudinal strip 10*b* running parallel to it without notches for tearing. This is, however, not imperative. As can be seen from the synopsis of FIGS. 1 and 2, the notches for tearing 13 at right-angles to the longitudinal strip 10 are incisions running from the outer border 14 of the latter at least as far as the longitudinal seam 5. The notches for tearing 13 can also be V-shaped nicks. In FIG. 3 the tubular wrapper 21 surrounding the gauze bandage 20 is shown in a sectional drawing. The web of foil 11 normally consists of composite material and can possess an inner polyethylene layer 1, suitable for the hot-melt welding process, an intermediate layer of aluminium laminate 2, and an outer protective layer 3, of polyester, for instance (FIG. 3). In FIG. 4 it is shown purely schematically that the longitudinal seam fin 5 emerging from one surface g of the packaging 4 is joined onto surface 9 at the side and the outer longitudinal strip 10*a* in each case is formed with notches for tearing 13. In this connection it is advantageous to join the longitudinal seam fin 5 to the surface 9 with glue 16. The opening behaviour can be improved even more by this means, as the tubular bag 4 can now be opened with the help of the second hand without the tear-off tongue being fixed in addition. As for the rest, the opening of the tubular bag 4 can be facilitated in that each tear-off tongue 12 possesses approximately the shape of a rectangle and has breadths and widths of between 10 mm and 18 mm respectively, suitable for grasping and tearing. The tubular bag packaging according to the invention is particularly suitable for sealing the packaging of bandage-like materials hermetically, they can be opened without any difficulties in such a way that the contents can be removed quickly and without damage occurring and can be manufactured in any commercially available tubular bag forming, filling and sealing machine using simple supplementary equipment and, in fact, at high packaging speeds employing the usual mechanical packaging appliances. In this respect the solution according to the invention performs the task posed at the beginning in an ideal manner.

LIST OF THE REFERENCE MARKS

1. Polyethylene layer 1
2. Intermediate layer
3. Polyester layer
4. Packaging
5. Longitudinal seam
6. Transverse seam
7. Border
8. Border
9. Surface of the packaging
10. Longitudinal strip
11. Web of foil
12. Tear-off tongues
13. Notches for tearing
14. Border of the longitudinal strip
15. Tab for pulling
16. Glued area
20. Material to be packed
21. Tube

I claim:

1. Tubular bag packaging for bandage-like material comprising a web of foil having opposite borders which are sealed together along a longitudinal seam to form a tube enveloping the material to be packed; two parallel transverse seams for hermetically sealing said tube at its ends, said tube having at least one aid to opening enabling said tube to be torn open quickly and completely, in order to remove contents;

a longitudinal strip of the web of foil projecting loosely beyond the longitudinal seam, said longitudinal strip being formed into comparatively short, continuously recurring longitudinal spaces having notches for tearing;

a tear-off tongue between said notches for tearing;

solid longitudinal strip comprising two longitudinal strips with one having notches for tearing and the other devoid of notches for tearing;

wherein both borders of the web of foil project beyond the longitudinal seam and the longitudinal strip having the notches for tearing being narrower than the longitudinal strip devoid of notches for tearing running parallel to it.

2. Packaging according to claim 1, wherein said notches for tearing at right-angles to the longitudinal strip are incisions running from the outer border of the longitudinal strip at least as far as the longitudinal seam.

3. Packaging according to claim 1, wherein the notches for tearing are V-shaped nicks.

4. Packaging according to claim 1, wherein there is a longitudinal seam fin, wherein the packaging has a side and has an outer longitudinal strip; and wherein the longitudinal seam fin emerging from one surface of the packaging is joined onto the surface at the side and the outer longitudinal strip in each case is formed with notches for tearing.

5. Packaging according to claim 4, wherein the longitudinal seam fin is joined to the surface by means of glue.

6. Packaging according to claim 1, wherein each tear-off tongue has approximately the shape of a rectangle.

7. Packaging according to claim 6, wherein said rectangle has a breadth and length of 10 mm and 18 mm, respectively, making it suitable for grasping and tearing.

* * * * *